United States Patent [19]

Walk

[11] Patent Number: 4,912,811

[45] Date of Patent: Apr. 3, 1990

[54] DEVICE TO OPEN FIBER BALES

[75] Inventor: Johann Walk, Eichstaett, Fed. Rep. of Germany

[73] Assignee: Schubert & Salzer Maschinenfabrik Aktiengesellschaft, Ingolstadt, Fed. Rep. of Germany

[21] Appl. No.: 255,226

[22] Filed: Oct. 11, 1988

[30] Foreign Application Priority Data

Oct. 12, 1987 [DE] Fed. Rep. of Germany ..... 3734480

[51] Int. Cl.[4] ..... D01G 7/06; A47L 5/38

[52] U.S. Cl. ..... 19/80 R; 19/97.5; 15/312 R

[58] Field of Search ..... 19/81, 80 R, 85, 97.5, 19/205; 57/304, 305; 15/312 A, 312 R

[56] References Cited

U.S. PATENT DOCUMENTS

| | | | |
|---|---|---|---|
| 3,063,874 | 11/1962 | Black, Jr. | 15/312 R |
| 3,437,520 | 4/1969 | Black, Jr. | 15/312 R |
| 3,806,979 | 4/1974 | Bonami | 15/312 R X |
| 4,109,875 | 8/1978 | Condarco et al. | 19/80 R X |
| 4,498,215 | 2/1985 | Heigeth et al. | 19/81 |
| 4,660,257 | 4/1987 | Binder et al. | 19/81 X |
| 4,698878 | 10/1987 | Büschgens et al. | 19/80 R |
| 4,750,240 | 6/1988 | Temberg | 19/80 R |

FOREIGN PATENT DOCUMENTS

| | | | |
|---|---|---|---|
| 3334222 | 4/1986 | Fed. Rep. of Germany . | |
| 3504590 | 8/1986 | Fed. Rep. of Germany . | |
| 608650 | 9/1960 | Italy | 15/312 R |
| 2149436 | 6/1985 | United Kingdom | 19/80 R |

*Primary Examiner*—Werner H. Schroeder
*Assistant Examiner*—Sara M. Current
*Attorney, Agent, or Firm*—Dority & Manning

[57] ABSTRACT

In a device for opening fiber bales with a plucking device capable of travelling on rails alongside a row of bales and of being lowered upon the bales, as well as with a suction channel, suction nozzles (72, 73, 82, 83) which suck away fiber material having fallen into the travel path of the plucking devices are connected.

16 Claims, 3 Drawing Sheets

DEVICE TO OPEN FIBER BALES

BACKGROUND OF THE INVENTION

The instant invention relates to a device to open fiber bales with a plucking device capable of travelling in rails alongside a row of bales and of being lowered upon the bales, as well as with a suction channel.

The removing of fiber bales set up in a row by means of a plucking device travelling alongside a rail track and being lowered for that purpose to the surface of the bales is known (See German Pat. Nos. DE-PS 3,334,222 and DE-PS 3.504.590). Extraction rollers covered by a suction hood are used as plucking devices, the rollers detaching fiber material from the bales with their teeth or needles and throwing it toward the suction hood where it is seized by a suction air stream and is conveyed through a pipe duct into a suction channel for further removal. It is, however, impossible with this device to prevent individual blocks, bunches of fibers and border strips of the fiber bales from falling to the floor next to the bale instead of entering the suction air stream. This can result in blockage of the rails and interferes with the moving mechanism.

SUMMARY OF THE INVENTION

It is the object of the instant invention to avoid this disadvantage and to ensure trouble-free plucking.

This object is attained through the invention in that suction nozzles which suck away fiber material having fallen into the travel zone of the plucking device are connected to the suction channel.

In a further embodiment of the invention the suction nozzles are made so as to be capable of travelling together with the plucking device. A greater cleaning area is created due to the fact that the suction nozzles extend near the floor from the edges of the fiber bales across, and beyond the rails. The suction nozzles are best installed before and after the plucking device, in the direction of travel, so that cleaning of the travel path in both directions of travel is made possible.

In a still further embodiment of the invention, the suction nozzles are installed in a stationary position at the ends of the track of the plucking device and strippers, which sweep the travel path and bring fiber material deposited there to the suction nozzles, are installed on the plucking device. In order to be able to switch the suction nozzles on and off as required, shut-off elements are provided for the suction nozzles. Due to the fact that a suction pipe connecting the suction nozzle to the suction channel and a pipe duct which conveys the fiber material taken from the fiber bales to the suction channel can be shut off, alternately, the available suction capacity required for fiber conveying is utilized efficiently and need not be increased.

BRIEF DESCRIPTION OF THE DRAWINGS

Embodiments of the invention are described through the drawings where.

DETAILED DESCRIPTION OF THE DRAWINGS

Figure 1:
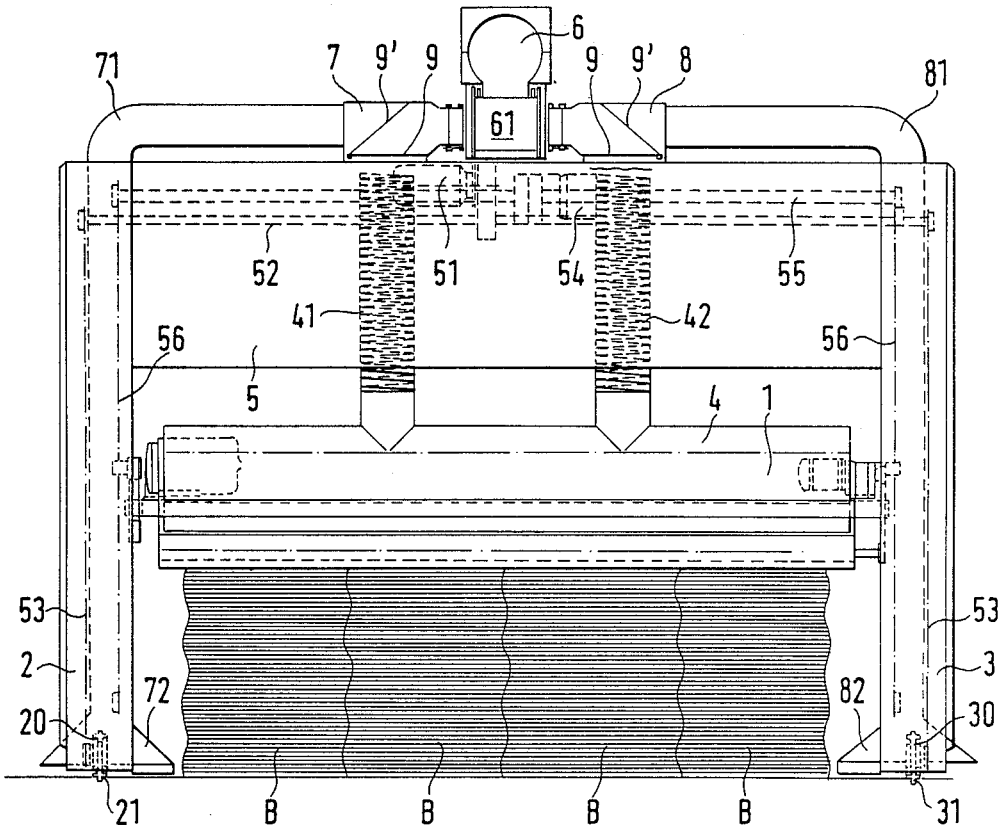
FIG. 1 shows a front view of a travelling plucking unit provided with suction nozzles.
Figure 3:
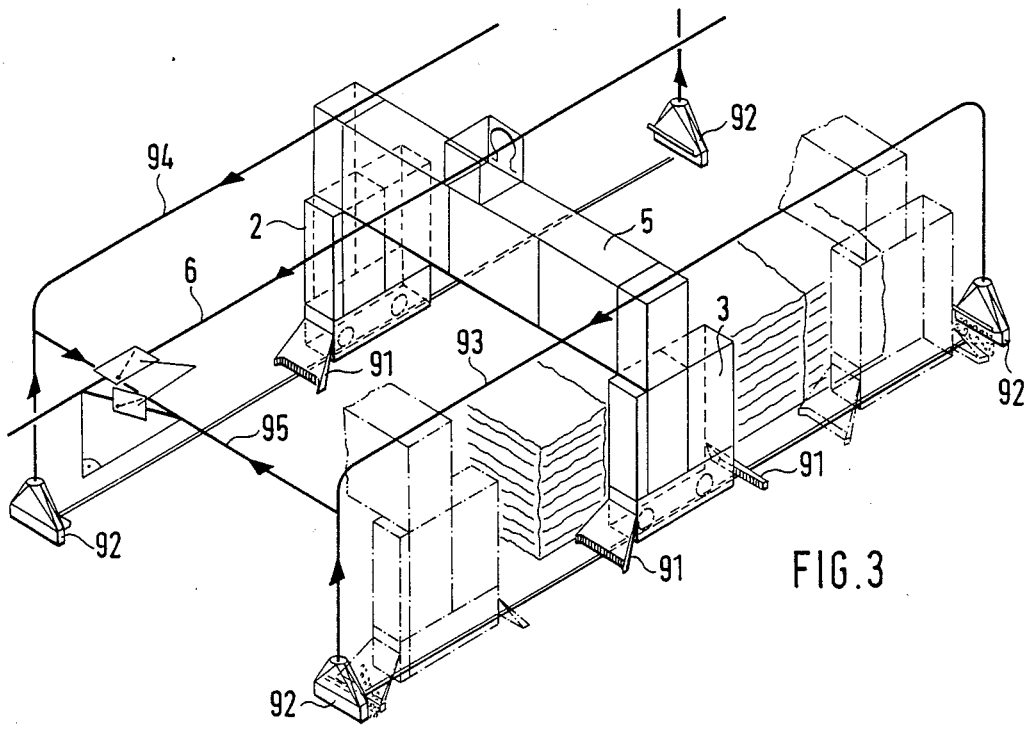
FIG. 3 shows a plucking device with strippers and stationary suction nozzles at the end of the track, in perspective.

In the embodiment of FIGS. 1 and 3, the plucking device consists of an extraction roll 1, made in form of a milling roll, which is supported in the lateral walls 2 and 3 of a machine frame and is covered by a suction hood 4. The lateral walls 2 and 3 are connected to each other by a bridge piece 5 and are equipped with running wheels 20 and 30 which run on the rails 21 and 31. The running wheels are driven by a motor 51 via a drive shaft 52 and the chain drives 53. The extraction roll 1 and the suction hood 4 are supported on a carriage guided in the lateral walls 2 and 3 and capable of being moved in the vertical direction by a motor 54 via a drive shaft 55 and the chain drives 56. For plucking, the extraction roll 1 can be lowered onto the bales B, which are lined up one behind the other, perpendicular to the plane of the drawing.

The suction hood 4 over the extraction roll has two suction openings at a distance from each other which are connected through pipe ducts 41 and 42 to a suction channel 6. The suction channel 6 is located above the bales B for consideration of air flow technology and to save space. The fiber taken by the extraction roll 1 from the bale surface, and thrown in direction of the suction hood 4, is conveyed into suction channel 6 by the suction air stream through the pipe ducts 41 and 42 which are, at least in part, made in the form of extensible bellows. The pipe ducts 41 and 42 are connected to the suction channel 6 via connection housings 7 and 8 which are attached to a carriage 61 suspended from the suction channel 6 so that they face each other. The carriage 61 has deflection rollers (not seen) over which a cover belt 62 (see FIG. 2) closing off the suction channel is guided in such manner that it uncovers a connection opening.

A suction pipe 71 or 81 opens at a right angle to the pipe ducts 41 or 42 into the connection housings 7 and 8. The suction pipes 71, 81 extend above the bales B to the lateral walls 2, 3 and then extend downward into proximity of the floor. The two suction pipes 71 and 81 connect suction nozzles 72 and 82 to the suction channel 6. The suction nozzles 72 and 82 exert suction at least over the rails 21 and 31 of the plucking device and ensure that the fiber lying on the rails is sucked away and removed through the suction pipes 71, 81 and through suction channel 6. Preferably, not only the rails 21 and 31 are cleaned, but also the area near the rails. The width of the suction nozzles 72 and 82 is, therefore, sized so that their suction slits extend from the border area immediately adjoining the fiber bales B and rails 21 and 31.

In cases where the removal of blocks takes place in one direction of travel only, provisions can be made for the rails and their adjoining areas not to be constantly subjected to suction but only when the plucking device travels back empty into its starting position. This is made possible by shut-off elements 9 located in both connection housings 7 and 8, consisting, in the embodiment shown, of pivoting flaps which close the pipe ducts 41 and 42 during empty travel and suction pipes 71 and 42 during plucking travel (position 9'). By switching the suction air stream over, the available suction capacity is used economically, at one time for the removal of the fiber blocks taken from the bales, and at another time for the removal of the fiber which has fallen near the bales during plucking. It is, therefore, not necessary to increase the suction capacity, as would be required in order to subject the travelling areas to constant suction. The shut-off flaps 9 can be actuated manually or through appropriate control by the travelling drive of the plucking device.

Figure 2:
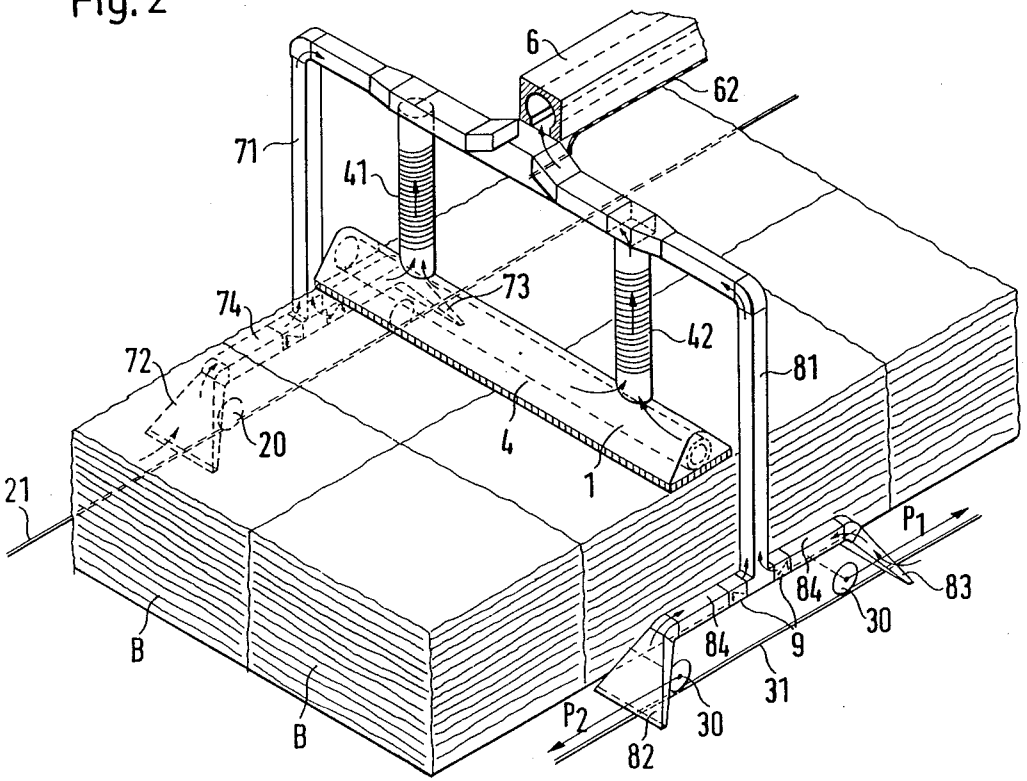
FIG. 2 shows the device of FIG. 1 with suction nozzles for both directions of travel, in perspective.

In the embodiment shown in FIG. 2, two pairs of suction nozzles 72, 73 and 82, 83 travels on either side of the row of bales and are also connected to the suction channel 9 via suction pipes 71 and 81 and extend from the bales B, across and beyond the rails 21 and 31. It is indicated to operate always only one of the two suction nozzles on either bale side to clean the travelling area of the plucking device. e.g., suction nozzle 73 on the one side and suction nozzle 83 on the other side of the row of bales when the plucking device travels in the direction of arrow P1. Inversely, suction nozzles 72 and 82 are then connected to the suction air when the direction of travel is P2. The alternating activation of the suction nozzles is controlled as required by the shut-off flaps 9 in the connecting pipe segments 74 and 84.

In FIG. 3, strippers 91, instead of suction nozzles, are attached to the lateral walls 2 and 3 and, thus travel together with these for the cleaning of the rails 21 and of their surrounding areas. Similarly to the arrangement of the suction nozzles in FIG. 2, two strippers 91 are provided on either side of the bales, so that one of these two strippers takes effect in either direction of travel and pushes the fiber fallen from the bales into the travel path before it to the end of the track. At the end of the track the suction nozzles 92, which are connected via pipe ducts 93, 904 and 95 to the suction channel 6 suspended over the bales B are installed in a stationary position. The fiber swept along by the strippers 91 thus reaches the suction nozzles 92 at the end of the track and is removed by the stream of suction air. The strippers 91 are suitably made in the form of brushes.

Figure 4:
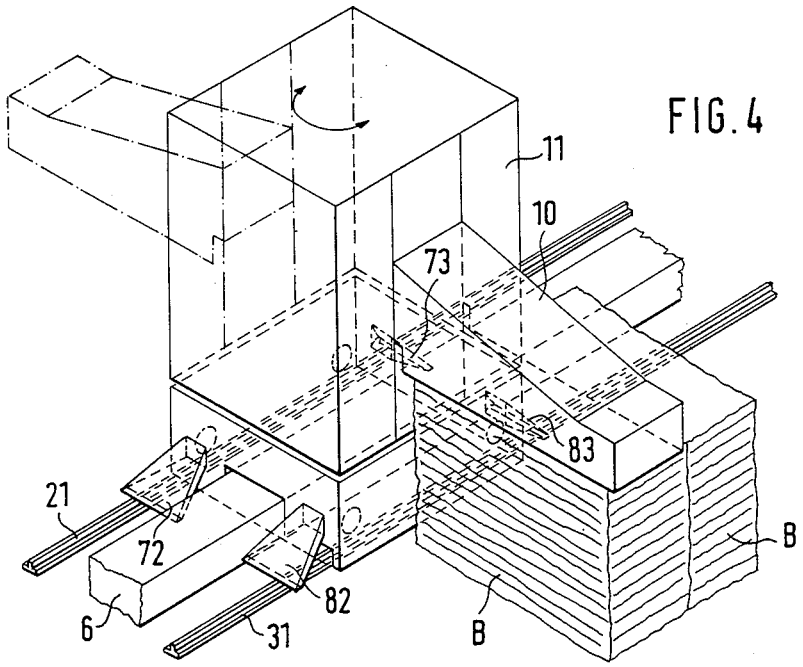
FIG. 4 shows another embodiment of the plucking device with suction nozzles, in perspective.

Cleaning means of the type shown or also of different types can, of course, be provided for all known plucking devices, designed for example as shown in FIG. 4. The extraction roll of FIGS. 1 and 2 is here mounted in a boom which is capable of moving in a vertical direction in a rotatable tower 11 travelling on the rails 21 and 31 and can be lowered onto the surface of the fiber bales B. The bales B can be set up on both sides of the rails 21 and 31 and can be plucked in sequence. The fiber removed by the extraction roller from the bales is sucked off through the suction channel 6, which is placed on the floor in this case, and is conveyed to the location of further processing. Near the floor, the suction nozzles 72 and 82 are installed on the tower 11 and are provided with suction slits which extend from the suction channel 6 across the rails 21 and 31 into proximity of the row of bales and suck up the fiber falling from the bales in that area, the fiber being then removed through the suction channel 6 with which the suction nozzles 72 and 82 are connected. A second pair of suction nozzles 73 and 83 are also connected to suction channel 6. The second pair of suction nozzles 73 and 83 on the other side of the tower 11 is suitably provided, so that the travel path is subjected to suction in both directions of travel of the plucking device, before the plucking device has passed that path.

What is claimed is:

1. A machine for opening a row of bales of fiber, comprising:

(a) A plucking device having means for removing fiber from the upper surfaces of said bales and suction means associated therewith for drawing off fiber removed from said bales by said plucking device;

(b) a carriage for supporting said plucking device, having a plurality of wheels for supporting said carriage for traversing movement alongside said row of bales;

(c) spaced guide rails disposed alongside said row of bales for engaging said wheels for guiding said carriage and said plucking device alongside said row of bales;

(d) cleaning means disposed on said carriage for removing fiber from said guide rails ahead of said wheels as said carriage moves alongside said row of bales; and (e) suction means for drawing off fiber removed from said rails by said cleaning means.

2. A machine as set forth in claim 1, wherein said suction means for drawing off fiber removed from said rails comprising a plurality of nozzles.

3. A machine as set forth in claim 2, wherein said nozzles are supported on said carriage for travel with said plucking device for travel with said plucking device.

4. A machine as set forth in claim 3, wherein said suction nozzles extend near the floor from the edges of said row of fiber bales over and beyond the guide rails.

5. A machine as set forth in claim 3, wherein said suction nozzles are disposed before and after the plucking device in the direction of travel.

6. A machine as set forth in claim 2, wherein said suction nozzles are disposed in stationary positions at the end of said rails for said plucking device and said cleaning means includes sweepers carried by said carriage for sweeping the travel path of said plucker to remove fiber deposited therein to the suction nozzles at the end of said rails.

7. A machine as set forth in claim 2, wherein said suction nozzles are provided with means for shutting off the suction thereat.

8. A machine as set forth in claim 7, wherein said nozzles are connected to a source of suction by suction pipes which include a shut-off element.

9. A machine for opening a row of bales of fiber, comprising:

(a) a plucking device having means for removing fiber from the upper surfaces of said bales and suction means associated therewith for drawing off fiber removed from said bales by said plucking device;

(b) a carriage for supporting said plucking device, having a plurality of wheels for supporting said carriage for traversing movement alongside said row of bales;

(c) spaced guide rails disposed alongside said row of bales for engaging said wheels for guiding said carriage and said plucking device alongside said row of bales;

(d) cleaning means disposed on said carriage for removing fiber from said guide rails ahead of said wheels as said carriage moves alongside said row of bales; and (e) suction means for drawing off fiber removed from said rails by said cleaning means which is associated with said suction means for drawing off fibers removed from said bales by said plucking device for transporting said fibers to a common collection point.

10. A machine as set forth in claim 9, wherein said suction means for drawing off fiber removed from said rails comprises a plurality of nozzles.

11. A machine as set forth in claim 10, wherein said nozzles are supported on said carriage for travel with said plucking device.

12. A machine as set forth in claim 11, wherein said suction nozzles extend near the floor from the edges of said row of fiber bales over and beyond the guide rails.

13. A machine as set forth in claim 11, wherein said suction nozzles are disposed before and after the plucking device in the direction of travel.

14. A machine as set forth in claim 10, wherein said suction nozzles are disposed in stationary positions at the end of said rails for said plucking device and said cleaning means includes sweepers carried by said carriage for sweeping the travel path of said plucker to remove fiber deposited therein to the suction nozzles at the end of said rails.

15. A machine as set forth in claim 10, wherein said suction nozzles are provided with means for shutting off the suction thereat.

16. A machine as set forth in claim 15, wherein said nozzles are connected to a source of suction by suction pipes which include a shut-off element.

* * * * *